United States Patent [19]

Eck

[11] Patent Number: 4,560,131

[45] Date of Patent: Dec. 24, 1985

[54] ANCHOR STAND

[75] Inventor: Leonard F. Eck, McPherson, Kans.

[73] Assignee: Hein-Werner Corporation, Waukesha, Wis.

[21] Appl. No.: 537,019

[22] Filed: Sep. 29, 1983

[51] Int. Cl.[4] ..... B21D 1/12

[52] U.S. Cl. ..... 248/352; 52/23; 52/DIG. 11; 72/705

[58] Field of Search ..... 248/352, 502, 500, 503; 52/23, DIG. 11, DIG. 3, 169.12, 704, 709; 72/705

[56] References Cited

U.S. PATENT DOCUMENTS

| | | | |
|---|---|---|---|
| 452,527 | 5/1891 | McElroy | 248/502 |
| 2,395,033 | 2/1946 | Blorek | 52/DIG. 11 |
| 3,713,259 | 1/1979 | Tkach . | |
| 3,772,838 | 11/1973 | Virnig | 52/23 |
| 3,828,491 | 8/1974 | Koon | 52/23 |
| 3,891,177 | 6/1975 | Jerrel . | |
| 3,990,207 | 11/1976 | Eck | 52/704 |
| 4,064,668 | 12/1977 | Carter . | |
| 4,079,983 | 5/1978 | Mastrigt | 52/709 |
| 4,236,400 | 12/1980 | Specktor . | |
| 4,337,636 | 7/1982 | Clausen . | |
| 4,400,969 | 8/1983 | Spector | 72/705 |

OTHER PUBLICATIONS

KMV Chainless Holddown System.

*Primary Examiner*—Reinaldo P. Machado
*Assistant Examiner*—Alvin Chin-Shue
*Attorney, Agent, or Firm*—Litman, Day and McMahon

[57] ABSTRACT

An anchor stand supports a vehicle above a floor surface and connects to an anchor pot device installed in a floor. The anchor stand includes an anchor bolt and nut to longitudinally draw the bolt and securely attach the stand to the anchor pot. An adjustable clamp is mounted on an uppermost portion of the stand for selectively attaching the anchor stand to a vehicle frame. Various frame straightening tools are then used to correct damage or misalignment of body and frame members.

3 Claims, 5 Drawing Figures

ANCHOR STAND

BACKGROUND OF THE INVENTION

The present invention relates generally to a vehicle frame straightening apparatus and more particularly to a device for securing vehicles while they are being acted upon by straightening devices. The particular device described herein is designed for use in conjunction with an anchor pot such as described in applicant's assignee Kansas Jack, Inc.'s U.S. Pat. No. 3,990,207.

Numerous devices have been developed to secure or anchor a vehicle during straightening of damaged or otherwise misaligned body and frame members. These arrangements are of two major types, the first type involving use of floor anchor pot in combination with chains and clamps. Clamps are connected to the vehicle body and a chain is extended between each clamp and an anchor pot and stretched taut by a chain shortener. Other chains and clamps are connected to the damaged areas and pulls on the chain are exerted by other chain pulling tools, such as described in Kansas Jack's U.S. Pat. No. 3,612,482. A problem with such arrangements arises in that too many chains clutter the work area and can be in the way of the repairman. Additionally, these anchoring systems can necessitate a lengthy set up time.

The other major type of anchor arrangement commonly used is a bench or frame system in which a clamp forms part of a very large and heavy framework which retains the vehicle against undesired movement. Such a framework can be very expensive, needs considerable space and requires special training for use.

The present anchoring system involves the use of a retaining device which secures the vehicle frame to the floor of the work area without chains or a heavy intervening framework. In this system, anchor pots are embedded and mounted flush in the floor of the work area and anchor stands are selectively connected to these anchor pots. A vehicle frame to be straightened is then elevated and secured to clamps on the anchor stands. Thus, the vehicle frame is securely affixed to the garage floor and separate straightening tools can be used to accomplish the desired work on the vehicle frame. A particular advantage to the present invention is that it is easily attached and detached from the anchor pot in the garage floor, so set up time is substantially reduced.

The present anchor stand is also preferably adjustable in order to accommodate varying frame sizes. Additionally, because the frame straightening forces applied to the vehicle during the straightening process can come from any of a number of directions, the instant anchor stand withstands sideloads from any of the expected directions.

OBJECTS OF THE INVENTION

The principal objects of the present invention are: to provide an anchor stand assembly for securing a vehicle frame while maintenance is performed thereon; to provide such an anchor stand which is quickly and easily set up to accommodate a vehicle; to provide such an anchor stand which can be removed from the garage floor leaving a smooth and unobstructed surface; to provide such an anchor stand which is easily adjustable to accommodate varying vehicle sizes; to provide such an anchor stand which may be securely affixed to the garage floor with only a single adjustment; to provide such an anchor stand which does not impair a worker's ability to maneuver about the vehicle; to provide such an anchor stand which can accommodate forces applied from any expected direction without requiring additional adjustment; and to provide such an anchor stand which is relatively inexpensive, sturdy and efficient in use and particularly well adapted for the intended purpose.

Other objects and advantages of this invention will become aparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
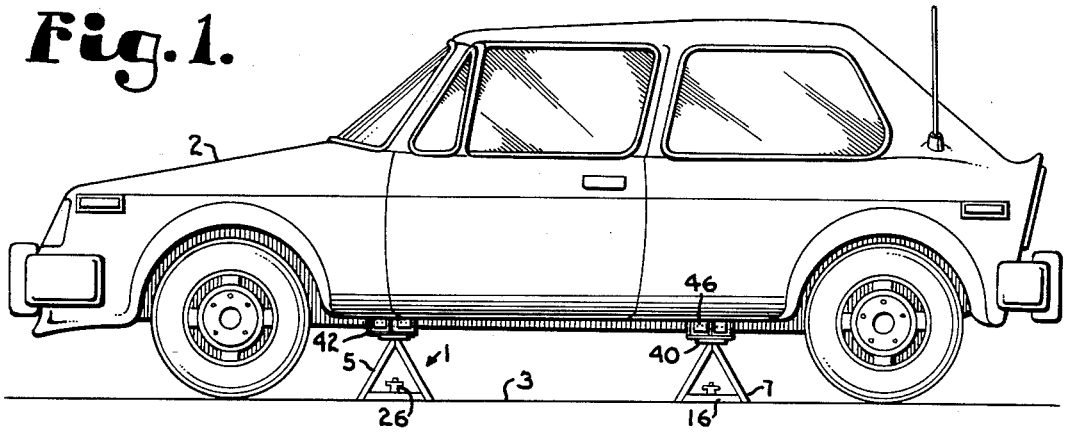
FIG. 1 is a side elevational view of a vehicle positioned on a set of anchor stands according to the present invention.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 3:
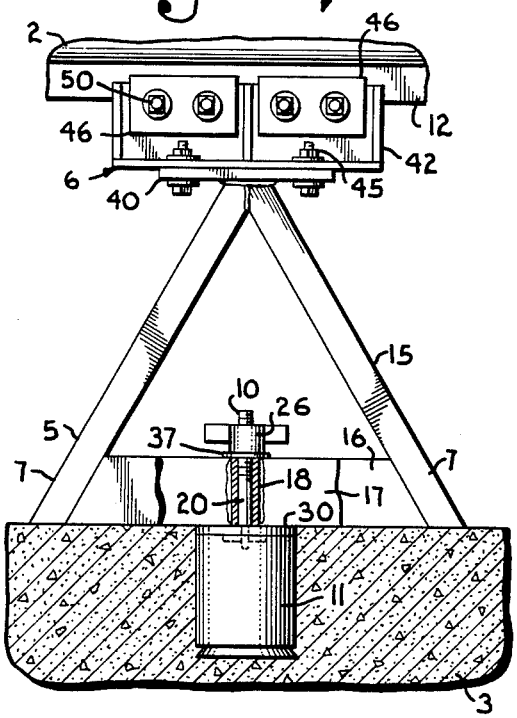
FIG. 3 is an enlarged side elevational view with the anchor stand shown connected to an anchor pot set in a concrete floor.
Figure 2:
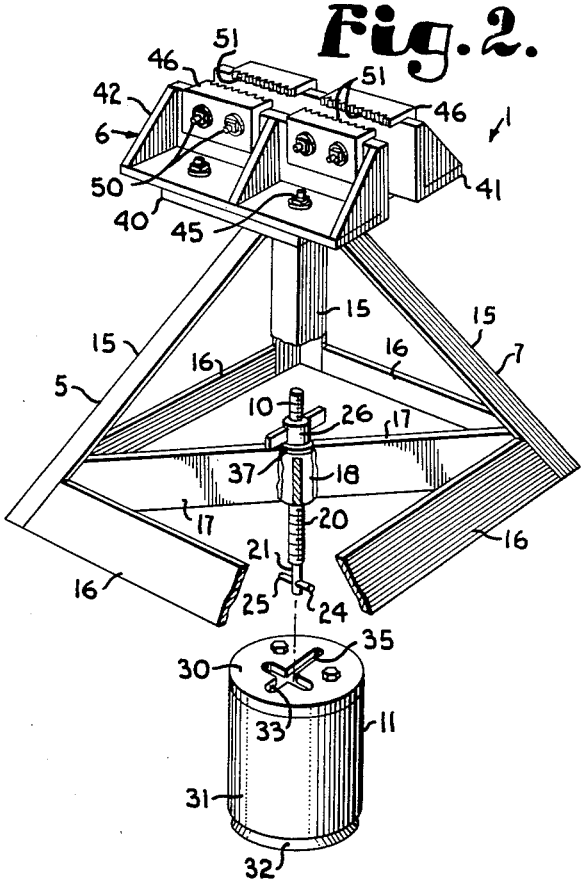
FIG. 2 is a perspective view of the anchor stand.
Figure 4:
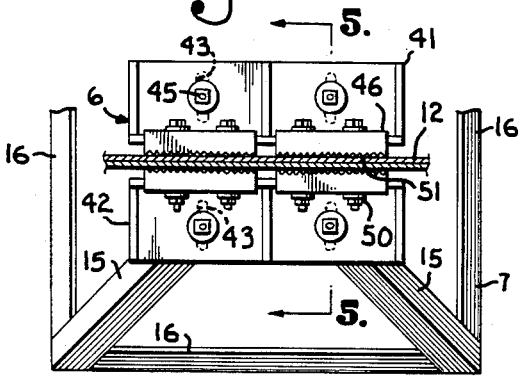
FIG. 4 is a fragmentary top plan view illustrating details of clamp members of the anchor stand.

Referring to the drawings in more detail:

The reference numeral 1, FIGS. 1, 2 and 3, generally indicates an anchor stand embodying the present invention and which is used for anchoring an automobile or vehicle body 2 to a garage floor 3, thus securing the vehicle body 2 in place so that repair may be undertaken. The anchor stand 1 is used in conjunction with various pulling tools, such as shown in Kansas Jack U.S. Pat. No. 3,612,482 to correct damaged or misaligned body and frame members. In use, several such anchor stands 1 are attached to the floor 3 of a garage, the vehicle body 2 is elevated and clamped to the anchor stand 1, and frame straightening apparatus, not shown, is then attached to the vehicle body 2. After the automobile body 2 is securely anchored to the garage floor 3 against movement, the frame straightening apparatus may be used to pull the damaged members of the vehicle body 2 into the proper configuration.

As shown in FIGS. 2 and 3, the anchor stand 1 includes a frame 5, a clamping portion 6 and a base portion 7. An anchor bolt 10 mounted in the base portion 7 of the anchor stand 1 engages an anchor pot 11 retained within the garage floor 3 and securely affixes the anchor stand 1 to the garage floor 3. The clamping portion 6 of the anchor stand 1 attaches to a pinch weld 12 or other appropriate portion of an automobile body 2 in order to securely anchor the automobile body 2 to the garage floor 3.

In the depicted embodiment, the frame 5 of the anchor stand 1 is substantially square pyramidal. The frame 5 has four legs 15, one at each of the upright edges of the square pyramid which provide the vertical support for the anchor stand 1. The base portion 7 of the anchor stand 1 includes four transverse members 16 which connect the four legs 15 of the frame 5 to provide support against compressional spreading, as by the downward force of the supported vehicle. The base portion 7 includes four diagonal or cross members 17 which also provide support for frame 5 against compressional spreading. Additionally, the cross members 17 support and retain a tubular bushing 18 in a position coaxial with a central vertical axis of the pyramidal frame 5.

The anchor bolt 10 has a shank 20 extending through the bushing 18, a tail 21 projecting downwardly therefrom and including two posts 24 and 25 which project oppositely. The shank 20 is threaded and fitted with a nut 26, preferably a wing or tail nut, and which is located adjacent an upper surface of the bushing 18, so as to draw the bolt 10 upwardly upon rotation.

FIG. 3 generally shows an assembled anchor stand 1 securely anchored to the garage floor 3. Embedded in the garage floor 3 is an anchor pot 11 of a type normally expected to be used in conjunction with the present invention. Referring to FIG. 2, the anchor pot 11 includes a top 30, a cylindrical sidewall 31 and a base 32. Further details are disclosed in Kansas Jack's U.S. Pat. No. 3,990,207 covering such anchor pot. Generally, the anchor pot 11 is embedded in the garage floor 3 with the sidewall 31 expanded and securing the anchor pot 11 in the floor with the anchor pot top 30 flush with the garage floor surface. The anchor pot top 30 includes a t-shaped slot 33.

During connection of the anchor stand 1 to the anchor pot 11, the tail 21, including posts 24 and 25, of the bolt 10 is received through the T-shaped slot 33 of the anchor pot 11, FIG. 2. The bolt 10 is then moved rearward or toward the end 35 of the T-shaped slot 33. This causes the posts 24 and 25 to engage the anchor pot top 30 when the bolt 10 is tightened upwardly and prevents removal of the bolt 10 from engagement with the anchor pot 11. Tightening of nut 26 and washer 37 onto the bolt 10 while the bolt shank 20 is extended through the tubular portion 18 draws the anchor stand 1 into secure engagement with the anchor pot 11 and the garage floor 3.

Figure 5:
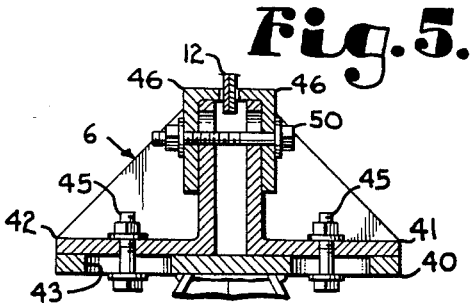
FIG. 5 is a transverse sectional view taken on line 5—5, FIG. 4, and illustrating further details of the clamp members.

The clamping portion 6 enables the automobile body 2 to be connected to the anchor stand 1. In the illustrated example, the clamping portion 6 comprises a plate 40 having opposed clamp jaws 41 and 42. Slots 43 in the plate 40 permit opening and closing of the clamp jaws 41 and 42 and selective positioning of them on the plate 40 by plate bolts 45. Engagement pads 46 connected to the clamping portion 6 by bolts 50 engage the automobile body 2. The engagement pads 46 may include serrated portions 51 for a gripping engagement between the jaws 41, 42 and the pinch weld 12. The clamping bolts 50, FIG. 5, pull the jaws 41 and 42 together tightly about the pinch weld 12.

Disconnecting the anchor stand 1 from the automobile body 2 and the garage floor 3 requires loosening of the clamping bolts 50, lifting the automobile off the anchor stands, and then loosening the nut 26. The bolt 10 is swung forwardly in the T-shaped slot so that the posts 24 and 25 are lifted therethrough. Having done the above permits the automobile to be removed from the anchor stands 1 and permits the anchor stands 1 to be removed from the garage floor 3.

It is to be understood that while certain forms of the present invention have been illustrated and described herein, it is not to be limited to the specific forms or arrangement of parts described and shown.

What is claimed and desired to be secured by Letters Patent is as follows:

1. An anchor stand for securing a vehicle and for use in combination with an anchor installed in a floor and comprising:

(a) a stand including spaced legs, a lower floor engaging portion and an upper portion;

(b) a clamp means mounted on said upper portion of said stand for engaging and supporting a vehicle on said stand;

(1) said clamp means including opposing jaws, a plate and engagement pads; said plate being substantially horizontally disposed, and adapted for selective positioning of said jaws thereon;

(c) a bolt member mounted in and extending downwardly from said floor engaging portion and having an upper nut associated therewith for grasping and rotation and a lower anchor engagement means for mounting said stand to said anchor; said bolt member being tightenable to selectively draw said stand against said floor;

(1) said bolt member being a threaded bolt;

(2) said lower anchor engagement means including posts extending oppositely form one another and being received by and selectively engaging with the anchor; and (3) said nut being threadably received on said bolt and permitting selective tightening and drawing of said stand into anchoring engagement with the anchor.

2. An anchor stand for securing a vehicle and for use in combination with an anchor installed in a floor comprising:

(a) a stand including spaced legs, a lower floor engaging portion and an upper portion;

(1) said stand being substantially frusto-pyramidal in shape, said shape being square pyramidal and said legs forming substantially vertical edges of said pyramidal stand;

(2) said lower floor engaging portion including a base of said pyramid and a central bushing;

(b) clamp means mounted on said upper portion of said stand for engaging and supporting a vehicle on said stand;

(1) said clamp means including opposing jaws, a plate and engagement pads; said plate being substantially horizontally disposed, and adapted for selective positioning of said jaws thereon, thereby allowing selective engagement of said engagement pads with a pinch weld of a vehicle;

(c) a bolt member mounted in and extending downwardly through said central bushing and having an upper head means associated therewith for grasping and rotation and a lower anchor engagement means for mounting said stand to the anchor;

(1) said bolt member being a threaded bolt;

(2) said lower anchor engagement means being a pair of posts extending from said bolt being received by and selectively engaging with the anchor;

(3) said head means being a nut threadably received on said bolt and permitting selective tightening and drawing of said stand into engagement with the anchor.

3. The anchor stand according the claim 2 wherein:

(a) said central bushing comprises an elongate cylindrical member snugly receiving a portion of said bolt member.

* * * * *